US005778576A

United States Patent [19]

Kaviani

[11] Patent Number: 5,778,576

[45] Date of Patent: Jul. 14, 1998

[54] NOVELTY LAMP

[75] Inventor: Ali Kaviani, Sicklerville, N.J.

[73] Assignee: Spencer Gifts, Egg Harbor Township, N.J.

[21] Appl. No.: 713,916

[22] Filed: Sep. 13, 1996

[51] Int. Cl.[6] ..... G09F 19/00

[52] U.S. Cl. ..... 40/409; 40/406

[58] Field of Search ..... 40/406, 409, 410, 40/411; 446/267

[56] References Cited

U.S. PATENT DOCUMENTS

| | | | |
|---|---|---|---|
| 1,856,098 | 5/1932 | Green . | |
| 2,383,941 | 9/1945 | Otis | 40/406 |
| 2,481,358 | 9/1949 | Smith . | |
| 2,518,502 | 8/1950 | Snyder | 40/406 X |
| 2,741,693 | 4/1956 | Fasson . | |
| 3,387,396 | 6/1968 | Smith . | |
| 3,570,156 | 3/1971 | Walker | 40/406 |

FOREIGN PATENT DOCUMENTS

| | | | |
|---|---|---|---|
| 184739 | 6/1936 | Switzerland | 40/406 |
| 1368242 | 9/1974 | United Kingdom | 40/406 |

*Primary Examiner*—Brian K. Green

*Attorney, Agent, or Firm*—Panitch Schwarze Jacobs & Nadel, P.C.

[57] ABSTRACT

A novelty lamp which comprises a transparent container with a top surface, a bottom surface, an outer portion, and an inner portion. The inner portion extends upwardly from the bottom surface of the container and defines a hollow area. The bottom surface of the container is mounted in a base member. Two substances are received in the container. One of the substances has a higher relative density at room temperature and is immiscible with the other substance. Upon application of heat, which is supplied by a light bulb mounted within the base member, globules of the substance with the initially higher relative density become less dense, rise in the other substance and flow around the outer and inner portions of the container. As the globules rise toward the top surface of the container they cool, become more dense and drop back down toward the bottom surface of the container.

8 Claims, 1 Drawing Sheet

NOVELTY LAMP

BACKGROUND OF THE INVENTION

The present invention is directed toward a novelty lamp and, more particularly, to such a device which includes a container with two substances of differing relative densities therein. The application of heat to the bottom of the container causes the substance with the initially greater relative density to rise in the other substance and flow around a structure which extends upwardly from the bottom of the container. The heat is supplied by a light bulb which also illuminates the novelty lamp to provide an aesthetically pleasing visual effect.

Novelty lamps of the type commonly referred to as "lava lamps" are well known in the art. An example of one such device is described in U.S. Pat. No. 3,387,396 to Smith. Such novelty lamps typically comprise a container which holds a paraffin based substance and a liquid substance. A heating element situated adjacent the bottom surface of the container heats the paraffin based substance causing the same to become flowable. The heating element is typically in the form of a light bulb so that the container and its contents can be illuminated.

When the paraffin based substance is sufficiently heated by the light bulb, globules are formed which are less dense than the liquid and therefore rise and circulate within the container. As the globules approach the top surface of the container they cool, become more dense and fall back toward the bottom surface. After the light bulb is turned off, the globules once again form one uniform mass which settles adjacent the bottom surface of the container.

Over the years, no significant changes have been made to such novelty lamps to improve the visual effect of the same. Accordingly, it is the main object of the present invention to provide a novelty lamp of the type described above with improved visually perceptible features.

SUMMARY OF THE INVENTION

In accordance with the illustrative embodiments, demonstrating features and advantages of the present invention, there is provided a novelty lamp which comprises a transparent container with a top surface, a bottom surface, an outer portion and an inner portion. The inner portion of the container extends upwardly from the bottom surface of the container and defines a hollow area. The bottom surface of the container is mounted in a base member. Two substances are received in the container. The substances are of contrasting color. One of the substances has a higher relative density and is immiscible with the other substance.

Upon application of heat, which is supplied by a light bulb mounted within the base member, globules of the substance with the initially higher relative density become less dense, rise in the other substance and flow around the outer and inner portions of the container. As the globules rise toward the top surface of the container they cool, drop back down toward the bottom surface of the container and rejoin with other globules to once again form one uniform mass.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
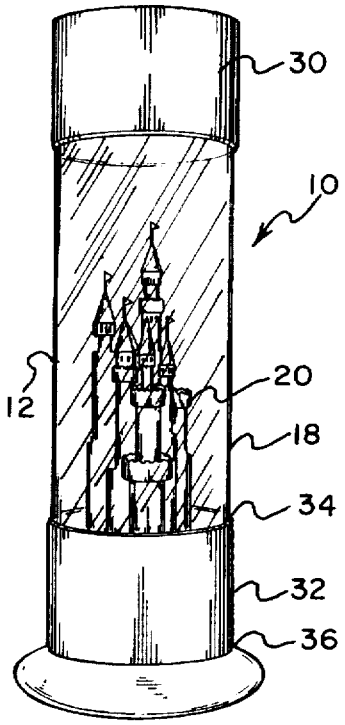
FIG 1 is a perspective view of a novelty lamp according to the present invention.

Referring now to the drawings in detail wherein like reference numerals have been used throughout the various figures to designate like elements, there is shown in the figures a novelty lamp constructed in accordance with the principles of the present invention and designated generally as 10.

Figure 2:
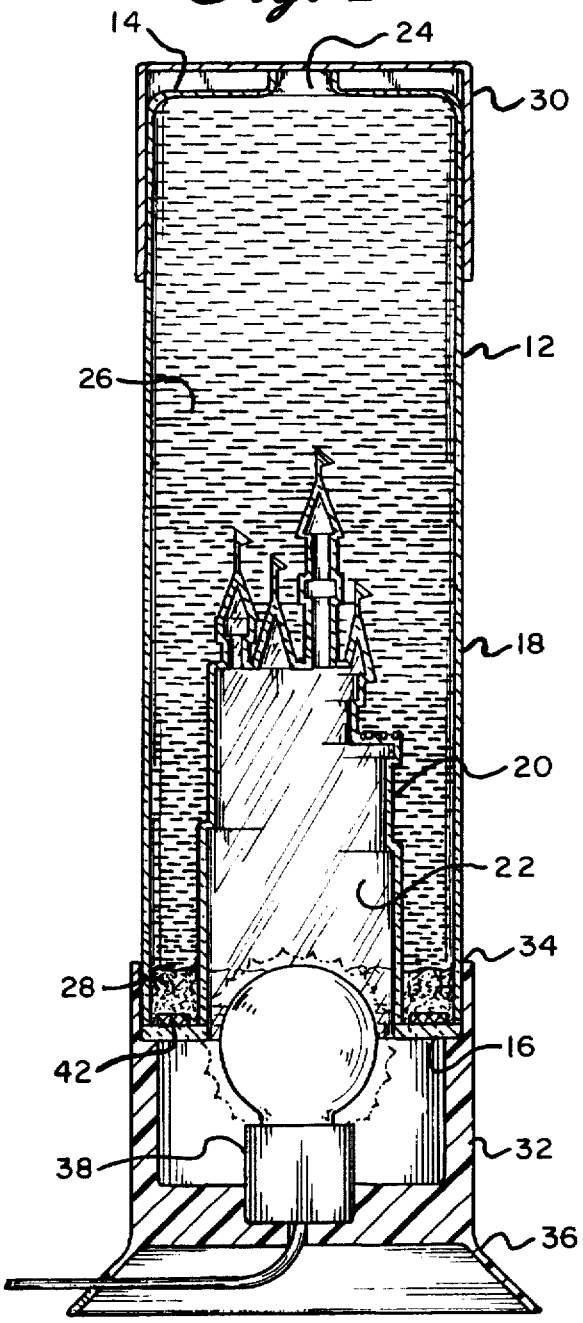
FIG. 2 is a cross sectional view of the novelty lamp.

The novelty lamp 10 includes a transparent container 12 with a top surface 14, a bottom surface 16, an outer portion 18 and an inner portion 20 (FIG. 2). The container is preferably comprised of glass. The inner portion 20 extends upwardly from the bottom surface 16 of the container and defines a hollow area 22. In a preferred embodiment, the inner portion 20 is castle shaped. However, the inner portion 20 can be shaped as a variety of other structures.

The height of the inner portion 20 is preferably equivalent to at least one half of the height of the outer portion 18, which is defined by the top and bottom surfaces of the container. The inner and outer portions can be integrally molded as one unit. However, the inner and outer portions can be distinct components with the inner portion being fastened to the outer portion.

The container 12 has an opening or fill spout 24 formed through the top surface 14 as shown in FIG. 2. A first substance 26, which is liquid at room temperature, is poured through the opening 24 until the container is substantially filled. Preferably, the first substance is comprised of water. A dye can be added to the liquid substance 26 to provide an aesthetically pleasing color. A second substance 28 is also inserted through the opening 24 in the top surface 14 of the container 18. The second substance is immiscible with the first substance.

In the preferred embodiment, the second substance is comprised of a paraffin based material of the type described in U.S. Pat. No. 3,387,396 to Smith. However, the second substance 28 can be comprised of other materials which have a higher relative density than the first substance 26 at room temperature and which have a lower relative density than the first substance at a higher temperature. The two substances should be of contrasting color so that they can be readily visually distinguishable from one another. Contrasting color could be different shades of one color or different colors altogether.

The paraffin based material 28 is solid at room temperature and has a surface tension which prevents the same from sticking to the walls of the container defined by inner and outer portions. Additionally, at room temperature, the paraffin based material settles on the bottom surface 16 of the container 12 as one uniform mass as best illustrated in FIG. 2.

Once the contents of the container have been received therein, the opening 24 in the top surface of the container is sealed by a cap 30 which is secured over the same. In the preferred embodiment, the cap 20 is friction fit over the top surface 14 of the container. However, the opening 24 can be sealed in a variety of other ways. For example, a stopper can be friction fit directly in the opening 24.

The novelty lamp 10 further includes a substantially hollow base member 32 with an open upper end 34 (FIG. 2) and a lower end 36. The bottom surface 16 of the container 12 is mounted in the base member 32. Extending upwardly from the lower end 36 of the base member 32 is a heating means 38. The heating means is preferably in the form of an electric light bulb which heats the paraffin based material 28 located adjacent the bottom surface 16 of the container 12. The bulb extends partially up into the hollow area 22 defined by the inner portion 20 of the container. The light bulb 38 also serves to illuminate the container 12 and the contents thereof in order to provide a pleasing visually perceptible appearance.

Figure 3:
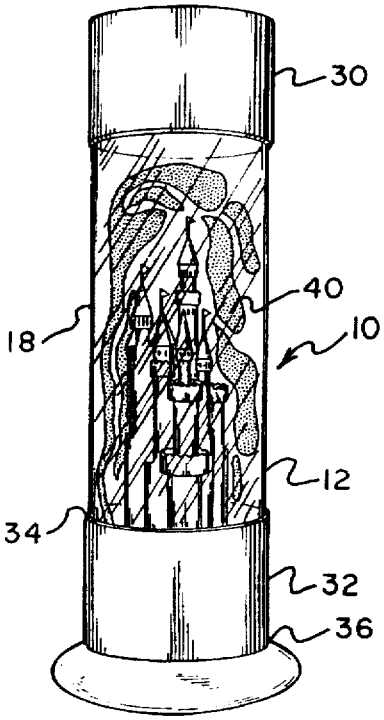
FIG. 3 is a perspective view of the present invention showing heated globules rising and falling around a castle shaped inner portion of the novelty lamp which is filled with a liquid substance.

As the paraffin based material 28 is heated to a suitable temperature, typically between 45 and 50° C., it becomes flowable about the liquid substance 26 between the outer and inner portions 18 and 20, respectively, of the container 12. Globules 40 of the paraffin based material 28 are also formed as the material 28 is heated (FIG. 3). Furthermore, the material 28 becomes less dense. When the relative density of the globules falls below the relative density of the liquid substance, the globules rise and circulate in the container. As the globules approach the top surface 14 of the container 12, they begin to cool and become more dense. When the relative density of each of the globules becomes greater than the relative density of the liquid substance 26, the globules 40 fall back down toward the bottom surface 16 of the container 12 where they re-unite with other globules which have already descended. The castle shape of the inner portion 20 provides a unique visual effect as the globules 40 rise and fall around the same.

In the preferred embodiment, a circular coil is positioned around the inner portion 20 of the container adjacent the bottom surface 16 thereof. The circular coil 42 is heated by the light bulb 38 and provides uniform heat around the bottom surface 16 of the container 12 in order to ensure that relatively large and homogeneous globules are formed (FIG. 2). The circular coil also causes descending globules to readily rejoin with other globules which have already descended.

The present invention may be embodied in other specific forms without departing from the spirit or essential attributes thereof and accordingly reference should be made to the appended claims rather than to the foregoing specification as indicating the scope of the invention.

What is claimed is:

1. A novelty lamp comprising:

a transparent container having a top surface, a bottom surface, an outer portion, and an inner portion having a shape, said container having a height defined by the top and bottom surfaces, said inner portion extending substantially upward from said bottom surface into an interior region that is equivalent to at least one quarter the height of said container;

a base member having an upper end and a lower end, said bottom surface of said container being mounted in said base member;

heating means positioned within said base member;

a first substance within said container, said first substance being a liquid at room temperature;

a second substance within said container, said second substance having a higher relative density than said first substance at room temperature and having a lower relative density than said first substance at a predetermined higher temperature, said substance being flowable about said first substance between said outer and inner portions of said container upon being heated to said predetermined higher temperature by said heating means.

2. The novelty lamp of claim 1 wherein said second substance is comprised of a paraffin based substance.

3. The novelty lamp of claim 1 wherein said heating means includes a light bulb, said light bulb being adapted to heat said second substance and to emit light through said upper end of said base member and into said container in order to illuminate said inner and outer portions of the container.

4. The novelty lamp of claim 3 further including a circular coil positioned around said inner portion of said container adjacent said bottom surface thereof.

5. The novelty lamp of claim 3 wherein said inner portion of said container defines a hollow area located in said interior region of the container.

6. The novelty lamp of claim 5 wherein said light bulb extends partially up into said hollow area in said container.

7. The novelty lamp of claim 1 wherein said outer portion of said container is cylindrical in shape.

8. A novelty lamp comprising:

a transparent container having a top surface, a bottom surface, an outer portion, and inner portion having a shape, said container having a height defined by the top and bottom surfaces, said inner portion extending substantially upward from said bottom surface into an interior region that is equivalent to at least one half the height of said container;

a base member having an upper end and a lower end, said bottom surface of said container being mounted in said base member;

heating means, positioned within said base member;

a first substance within said container, said first substance being a liquid at room temperature;

a second substance within said container said second substance having a higher relative density than said first substance at room temperature and having a lower relative density than said first substance at a predetermined higher temperature, said second substance being flowable about said first substance between said outer and inner portions of said container upon being heated to said predetermined higher temperature by said heating means.

* * * * *